US006336465B1

(12) United States Patent
Surrendi et al.

(10) Patent No.: US 6,336,465 B1
(45) Date of Patent: Jan. 8, 2002

(54) CLEVIS ASSEMBLY AND FLY ADAPTOR ASSEMBLY FOR COLLAPSIBLE UMBRELLA TENT AND FRAME THEREFOR

(75) Inventors: Dennis C. Surrendi, 2 Ironstone Place, St. Alberta (CA), T8N 5J6; Paul V. Allegretto, Avon, CT (US)

(73) Assignees: Dennis C. Surrendi; Donald F. Freeland, both of (CA)

( * ) Notice: Subject to any disclaimer, the term of this patent is extended or adjusted under 35 U.S.C. 154(b) by 0 days.

(21) Appl. No.: 09/000,256

(22) PCT Filed: Aug. 1, 1996

(86) PCT No.: PCT/IB96/01080

§ 371 Date: Oct. 1, 1998

§ 102(e) Date: Oct. 1, 1998

(87) PCT Pub. No.: WO97/06325

PCT Pub. Date: Feb. 20, 1997

(Under 37 CFR 1.47)

(51) Int. Cl.[7] ..... E04H 15/36

(52) U.S. Cl. ..... 135/128; 135/121; 135/147; 135/98

(58) Field of Search ..... 135/98, 121, 124, 135/128, 143, 147

(56) References Cited

U.S. PATENT DOCUMENTS

| | | | |
|---|---|---|---|
| 1,079,757 | A | 11/1913 | Gould |
| 1,124,420 | A | 1/1915 | Gough |
| 1,666,757 | A | 4/1928 | Snyder |
| 2,742,912 | A | 4/1956 | Blanchard |
| 3,000,386 | A | 9/1961 | Schulze et al. |
| 3,044,477 | A | 7/1962 | Higgns |

(List continued on next page.)

*Primary Examiner*—Beth A. Stephan
(74) *Attorney, Agent, or Firm*—Rothwell, Figg, Ernst & Manbeck, p.c.

(57) ABSTRACT

The present invention is directed to a modified clevis assembly for collapsible tents. The clevis assembly is modified so that it contains a conical pin entry guide on a first clevis member to allow safe directing of the tip of the pin on a second clevis member into the recess of the first clevis member. In the modified clevis assembly the pin is guided into the recess should any torque or twist to the frame occur when the tent is erected due to the inherent flexibility of the materials used in the construction of tent frames and the tendency for the user to inadvertently apply force off of vertical through pressure from the user's hands when moving the lower clevis member toward the upper clevis member. The conical pin entry guide preferably forms an integral part of the under surface of the upper clevis member or of the upper surface of the lower clevis member. The clevis assembly is further optionally modified to include in or on the upper clevis member means to receive a fly adaptor assembly. The fly adaptor receiving means may be a centrally located hollow core extending from the center of the upper surface of the upper clevis member vertically through the center of the upper clevis member out of the base of the upper clevis member to the apex of the conical pin entry guide or a pin socket or recess at the apex of the conical pin entry guide, or a centrally located fly adaptor receptacle in the upper surface of the upper clevis member, or a centrally and vertically protruding pin from the upper surface of the upper clevis member. The present invention is further directed to a fly adaptor assembly which allows the user to mount a fly cover on an as needed basis on a collapsible umbrella tent. The fly adaptor assembly comprises a single clevis member with a plurality of arms. Centrally mounted on the underside of the fly adaptor assembly's clevis member is a means to attach the fly adaptor to the modified upper clevis member of the collapsible tent's frame. The attachment means of the fly adaptor is designed to mate with the fly adaptor receiving means of the upper clevis member of the tent frame.

27 Claims, 18 Drawing Sheets

U.S. PATENT DOCUMENTS

| | | | |
|---|---|---|---|
| 3,181,542 | A | 5/1965 | Bareis |
| 3,181,543 | A | 5/1965 | Petrie |
| 3,621,857 | A | 11/1971 | May et al. |
| 3,794,054 | A | 2/1974 | Watts |
| 3,929,146 | A | 12/1975 | Maiken |
| 4,033,366 | A | 7/1977 | Forget |
| 4,102,352 | A | 7/1978 | Kirkham |
| 4,201,237 | A | 5/1980 | Watts et al. |
| 4,709,718 | A | 12/1987 | Nichols |
| 4,750,509 | A | 6/1988 | Kim |
| 4,858,635 | A | 8/1989 | Eppenbach |
| 4,945,936 | A | 8/1990 | Surrendi |
| 4,966,178 | A | 10/1990 | Eichhorn |
| 4,966,179 | A | 10/1990 | Baldwin et al. |
| 5,067,505 | A | 11/1991 | Cantwell et al.- |

CLEVIS ASSEMBLY AND FLY ADAPTOR ASSEMBLY FOR COLLAPSIBLE UMBRELLA TENT AND FRAME THEREFOR

This application is a 371 of PCT/IB96/01080 filed Aug. 1, 1996.

FIELD OF THE INVENTION

The present invention relates to an improved collapsible umbrella tent and specifically to an improved clevis assembly which has an improved locking mechanism. The improved clevis assembly may further contain an enhanced feature for adding a separate fly adaptor assembly to which a fly sheet may be added to such tents.

BACKGROUND OF THE INVENTION

Umbrella tents have a long history of existence and use. Collapsible umbrella tents date back to the beginning of this century and have usually included a collapsible frame on which the fabric or other flexible sheet material of the tent is supported when the tent has been erected. The reference to "umbrella" tents is commonly used in the commercial trades because such tents can be erected and dismantled in much the same manner as an umbrella. An example of a contemporary umbrella tent can be found in U.S. Pat. No. 4,945,936. Other examples of collapsible umbrella tents can be found in U.S. Pat. Nos. 4,033,366; 3,929,146; 3,794,054; 3,000,386; 1,666,757; 1,124,420; and 1,079,757. Generally, tents of the umbrella type are normally comprised of a collapsible frame which has a plurality of legs pivoted at their upper ends by a clevis assembly having an upper clevis member and a lower clevis member. Each leg has a radial stay member that is attached from the upper end of the leg and faces inward with each stay member connected inwardly to a lower clevis member. The upper and lower clevis members are designed to engage when the tent is erected. The upper clevis member may contain a central downwardly opening recess, while the lower clevis member contains a central upwardly projecting pin, post or rod as shown in U.S. Pat. No. 4,945,936. Alternatively, the upper clevis member may contain a central downwardly projecting pin, post or rod, while the lower clevis member contains a central opening recess as shown in U.S. Pat. No. 3,929,146. One disadvantage of these tents lie in this arrangement of the locking mechanism for the joining of the lower and upper clevis members when the tent is erected. This disadvantage is due, in part, to the torque and twist forces put on the clevis members as the tent is erected. Thus, one object of the present invention is to improve the locking mechanism of collapsible umbrella type tents.

Collapsible tents have been made with the frame exterior to the tent fabric (see for example U.S. Pat. No. 4,945,936), or with the frame interior to the tent fabric (see for example U.S. Pat. No. 3,929,146). Either type of tent can also be provided with fly covers which provide an air space between the tent fabric and the fly cover. (A fly cover is sometimes referred to herein as a fly sheet or simply a fly.) This air space can act as a water barrier and an insulator for the user. Although a fly cover has previously been applied to collapsible tents with an exterior frame, it is desired to improve the attachment of a fly cover to the external frame collapsible tents in order to expedite the setup of the tent and fly cover. In addition, collapsible tents with an internal frame do not normally have the technical design to accommodate the addition of a fly cover when needed. Thus, one object of the invention is to provide a fly adaptor assembly and a modified clevis assembly for the optional attachment of the fly adaptor assembly to the modified clevis member to aid in securing a fly cover to a collapsible tent.

SUMMARY OF THE INVENTION

The present invention is directed to a modified clevis assembly for collapsible tents. The clevis assembly is modified so that it contains a conical pin (post or rod) entry guide on a first clevis member to allow safe directing of the tip of the pin on a second clevis member into the recess of the first clevis member. In the modified clevis assembly the pin is guided into the recess should any torque or twist to the frame occur when the tent is erected due to the inherent flexibility of the materials used in the construction of tent frames and the tendency for the user to inadvertently apply force off of vertical through pressure from the user's hands when moving the lower clevis member toward the upper clevis member. In one embodiment, the upper clevis member is modified to include a central downwardly opening recess in its under side that advantageously includes a conical pin entry guide to allow for the safe directing of the tip of the upwardly facing pin centrally located in the center of the upper surface of the lower clevis member. The conical pin entry guide forms an integral part of the under surface of the upper clevis member. The conical pin entry guide may be modified to include a downwardly extending shroud extension which is an integral part of the upper clevis member.

In a second embodiment, the lower clevis member is modified to include a central upwardly opening recess in its upper side that advantageously includes a conical pin entry guide to allow for the safe directing of the tip of the downwardly facing pin centrally located in the center of the under surface of the upper clevis member. The conical pin entry guide preferably forms an integral part of the upper surface of the lower clevis member. The conical pin entry guide may be modified to include an upwardly extending shroud extension which is an integral part of the lower clevis member.

The clevis assembly is further optionally modified to include in or on the upper clevis member means to receive a fly adaptor assembly. In one embodiment, the upper clevis member is modified to have a centrally located hollow core extending from the center of the upper surface of the upper clevis member vertically through the center of the upper clevis member out the base of the upper clevis member to the apex of the conical pin entry guide. In a second embodiment, this centrally located hollow core is replaced by a centrally located fly adaptor receptacle in the upper surface of the upper clevis member. In a third embodiment, the upper clevis member includes a centrally and vertically protruding pin from the upper surface of the upper clevis member.

The present invention is further directed to a fly adaptor assembly. The fly adaptor assembly advantageously allows the user to mount the fly cover on an as needed basis on a collapsible umbrella tent. The fly adaptor assembly is advantageously used with such tents in which the frame is located interior to the tent fabric. The fly adaptor assembly comprises a single clevis member with a plurality of arms. Centrally mounted on the underside of the fly adaptor assembly's clevis member is a means to attach the fly adaptor to the modified upper clevis member of the collapsible tent's frame. The attachment means of the fly adaptor is designed to mate with the fly adaptor receiving means of the upper clevis member of the tent frame.

DETAILED DESCRIPTION OF THE INVENTION

Figure 1A:
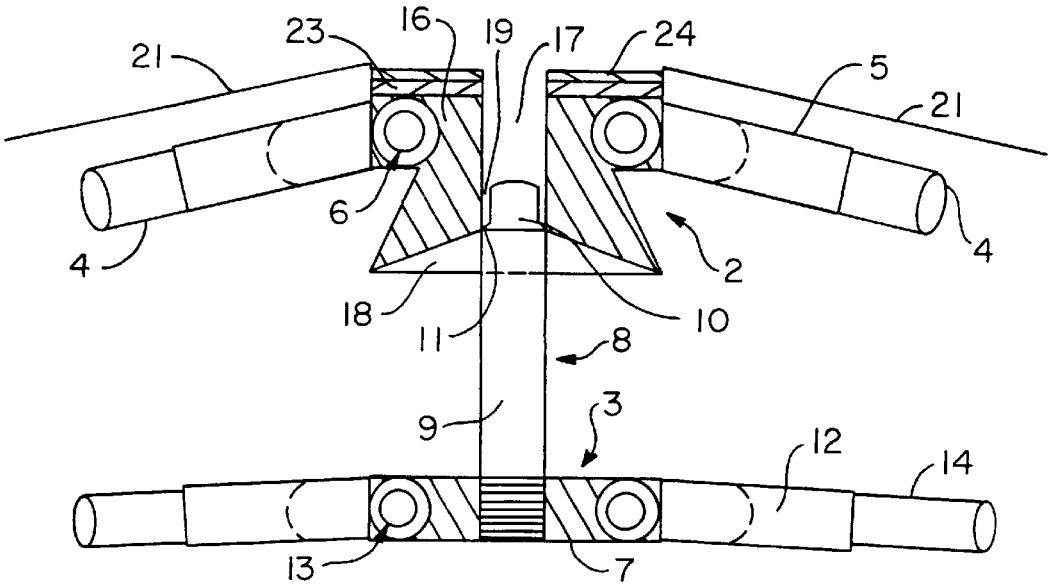
FIG. 1A is a cross sectional view of a clevis assembly of a collapsible tent with the upper clevis member having a conical pin entry guide on its underside and a vertical hollow opening through its center with a fly adaptor receptacle in the center of its upper surface and the lower clevis member having a pin projecting upwardly from its upper surface.

The present invention is directed to a modified clevis assembly and a fly adaptor assembly for collapsible tents. The modified clevis assembly can be utilized in the construction of frames for collapsible tents and in collapsible tents known in the art, including those described in the patents identified above. The modified clevis assembly can be used in collapsible tent frames in which are either exterior to the tent fabric or interior to the tent fabric. The fly adaptor assembly can be used with clevis assemblies modified to allow for the attachment of the fly adaptor assembly. Several such modifications are described below. The modified clevis assembly and fly adaptor assembly of the present invention can be used with collapsible umbrella tent frames manufactured from any suitable materials used in such tents including, but not limited to, metals, fiberglass, carbon fibers, or plastics. Similarly, the modified clevis assembly and fly adaptor assembly and any of their components can be manufactured of any suitable materials used for collapsible tents.

In general, the clevis assembly is modified so that one of the two members (either the upper or lower clevis member) accommodates a unique conical pin entry guide that provides a safe guiding mechanism for the consistent entry of the pin centrally located on the other clevis member and serving to guide the tip of the pin into the locked position on assembly of the frame. In addition, the upper surface of the upper clevis member is modified to accommodate the securement of a unique fly adaptor assembly.

More specifically, the clevis assembly is modified so that it contains a conical pin (post or rod) entry guide on a first clevis member to allow safe directing of the tip of the pin on a second clevis member into the recess of the first clevis member. In the modified clevis assembly, the pin is guided into the recess should any torque or twist to the frame occur when the tent is erected due to the inherent flexibility of the materials used in the construction of tent frames and the tendency for the user to inadvertently apply force off of vertical through pressure from the user's hands when moving the lower clevis member toward the upper clevis member. The conical pin entry guide may also include an integral shroud extension to allow the pin to be intercepted by the shroud extension at an early stage in the erection of the frame. This shroud extension is particularly useful when flexible materials are used in the tent frame and provides an additional measure of safety to the user.

In one embodiment, the upper clevis member of a clevis assembly is modified to include a central downwardly opening recess in its under side that advantageously includes a conical pin entry guide to allow for the safe directing of the tip of the upwardly facing pin centrally located in the center of the upper surface of the lower clevis member. The conical pin entry guide forms an integral part of the under surface of the upper clevis member. In a second embodiment, the lower clevis member of a clevis assembly is modified to include a central upwardly opening recess in its upper side that advantageously includes a conical pin entry guide to allow for the safe directing of the tip of the downwardly facing pin centrally located in the center of the under surface of the upper clevis member. The conical pin entry guide preferably forms an integral part of the upper surface of the lower clevis member.

The clevis assembly is further optionally modified to include in or on the upper clevis member means to receive a fly adaptor assembly. In one embodiment, the upper clevis member is modified to have a centrally located hollow core extending from the center of the upper surface of the upper clevis member vertically through the center of the upper clevis member out the base of the upper clevis member to the apex of the conical pin entry guide. In a second embodiment, this centrally located hollow core is replaced by a centrally located fly adaptor receptacle in the upper surface of the upper clevis member. In a third embodiment, the upper clevis member includes a centrally and vertically protruding pin from the upper surface of the upper clevis member.

The present invention is further directed to a fly adaptor assembly. The fly adaptor assembly advantageously allows the user to mount the fly cover on an as needed basis on a collapsible umbrella tent. The fly adaptor assembly is advantageously used with such tents in which the frame is located interior to the tent fabric. The fly adaptor assembly comprises a single clevis member with a plurality of arms. Centrally mounted on the underside of the fly adaptor assembly's clevis member is a means to attach the fly adaptor to the modified upper clevis member of the collapsible tent's frame. The attachment means of the fly adaptor is designed to mate with the fly adaptor receiving means of the upper clevis member of the tent frame. Thus, in one embodiment the underside of the fly adaptor assembly clevis has a centrally located, downwardly projecting pin. In a second embodiment, the underside of the fly adaptor clevis has a centrally located recess. In a third embodiment, the underside of the fly adaptor assembly clevis has a centrally located hollow pedestal mount. The fly adaptor assembly may also contain means for securing a fly cover to aid in proper installation of the fly cover to the collapsible tent.

The details of the modified clevis assembly and the fly adaptor assembly follows. The modified clevis assembly can be utilized with any tent frame directly or after slight modifications to take into consideration the design features of a particular tent frame. Such modifications will be readily apparent to a person skilled in making tent frames. In addition, the clevis assembly and fly adaptor assembly are designed to be used with tents in which the fabric is exterior to the tent frame or interior to the tent frame. The attachment of the fabric to each type of tent is well known in the art. Suitable tent frames include those described in the patents referred to above. Especially suitable tent frames can be found in U.S. Pat. Nos. 4,945,936 and 3,929,146, both incorporated herein by reference.

The modified clevis assembly of the present invention is illustrated in FIGS. 1A–1G and 2A–2B. According to these figures, the clevis assembly 1 comprises an upper clevis member 2 and a lower clevis member 3. A plurality of legs (not shown) of a tent frame (not shown) are connected to the clevis assembly 1. Each leg comprises an upper section 4 and lower section (not shown) or sections with each section being pivotally connected to each other. The upper section 4 of each leg is pivotally connected to the upper clevis member 2 by a pivot connector 5 with pin 6. The legs and pivot connector 5 are of any suitable tent construction material. Each upper leg section 4 readily bend to follow the curvature necessary to lead to the upper clevis member 2 of the clevis assembly 1.

Figure 1B:
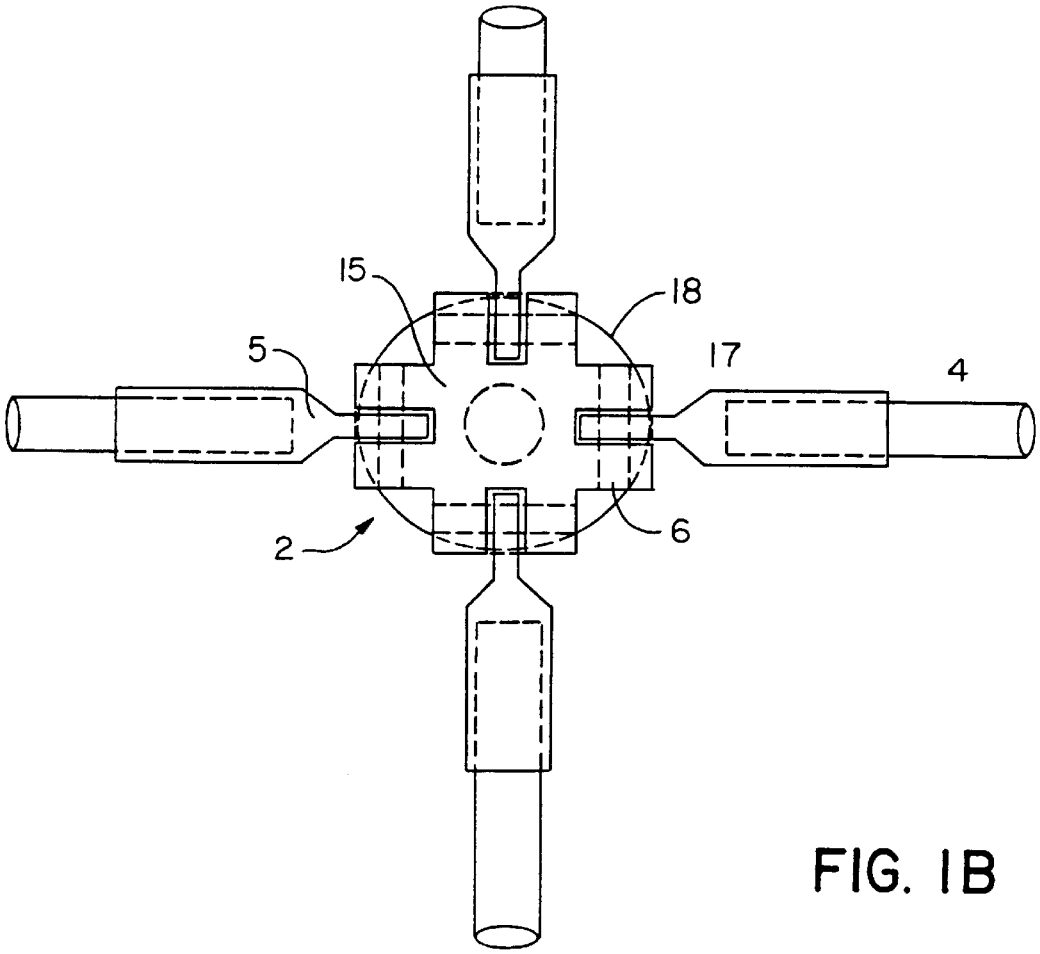
FIG. 1B is a top view of the upper clevis member shown in FIG. 1A.

In the embodiment shown in FIG. 1A and 1B, the lower clevis member 3 comprises a main body 7 having a central recess on its upper surface within which a center pin 8 is mounted. The center pin 8 may be mounted by a threaded base at one end of the center pin 8 or, alternately, mounted in the recess by bonding the end of the center pin 8 into the recess of the lower clevis member 3. The upward facing pin 8 has a main body 9 of larger diameter and pin tip 10 of smaller diameter at the upper end joining the body 9 in an upwardly directed shoulder 11. Optionally, a stop member (not shown) dimensioned and shaped to fit slidably within the upper clevis member 2 can be seated on the shoulder 11. The lower clevis member 3 further comprises a pivot connector 12 pivotally connected to the lower clevis member by pin 13. Each pivot connector 12 receives a radial member 14 of the tent frame.

The upper clevis member 2 is advantageously designed to comprise a main body 15 having a base 16 and a vertical hollow opening 17 extending through the upper clevis member 2. The base 16 extends downward in a column that has on its underside facing the lower clevis member 3 a conically tapered pin entry guide 18 culminating at its apex in a recess or socket 19 at the lower end of the hollow opening 17. The recess 19 is dimensioned and shaped to suitably receive the pin tip 10 of the pin 8 extending vertically from the lower clevis member 3. The conically tapered pin entry guide 18 guides the pin 8 into the recess 19 in the event the pin tip 10 deviates from the target of the recess 19 due to torque or twist of the lower clevis member 3 during erection of the tent frame. If the shoulder 11 of pin 8 contains a stop member, the stop member fits within recess 19.

Figure 1C:
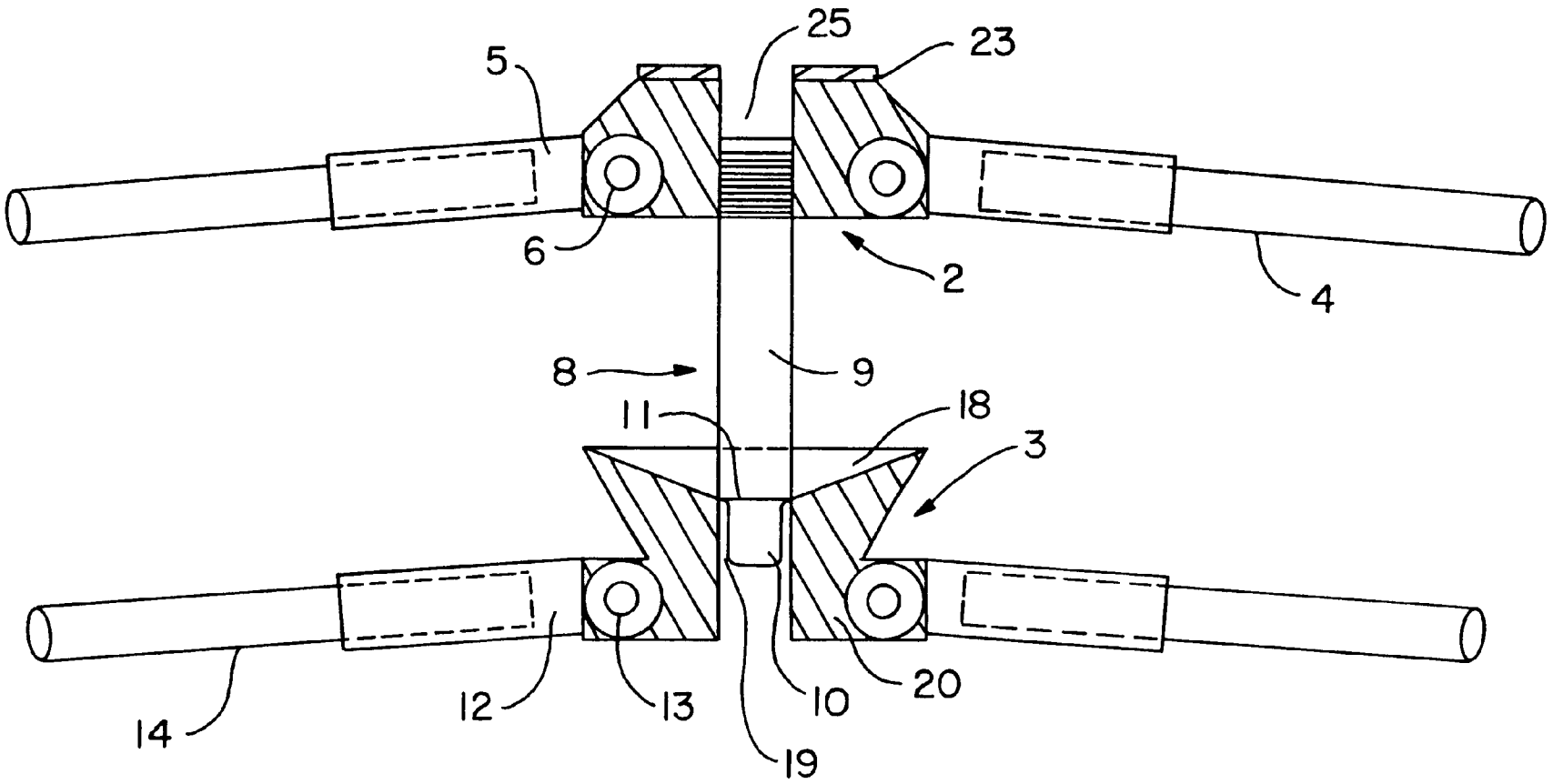
FIG. 1C is a cross sectional view of a clevis assembly of a collapsible tent with the lower clevis member having a conical pin entry guide on its upper surface and a vertical hollow opening through its center and the upper clevis member having a pin projecting downwardly from its under surface and a fly adaptor receptacle in the center of its upper surface.
Figure 1D:
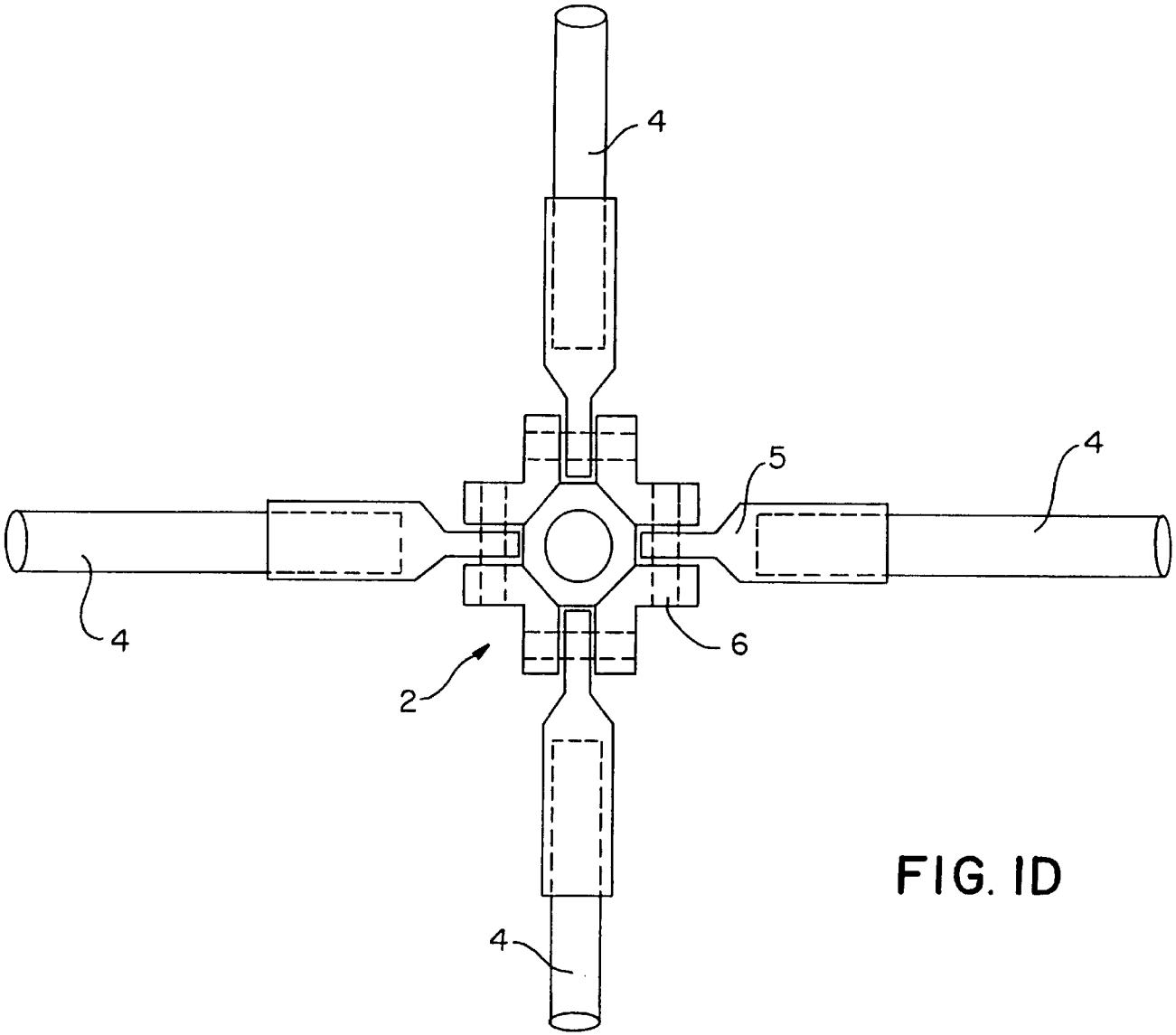
FIG. 1D is a top view of the upper clevis member shown in FIG. 1C.

In the embodiment shown in FIGS. 1C and 1D, the upper clevis member 2 comprises a main body 15 having a central recess in its lower surface within which a center pin 8 is mounted. The center pin 8 may be mounted by a threaded base at one end of the center pin 8 or, alternately, mounted in the recess by bonding the end of the center pin 8 into the recess of the upper clevis member 2. The downward facing pin 8 has a main body 9 of larger diameter and pin tip 10 of smaller diameter at the lower end joining the body 9 in an downwardly directed shoulder 11. Optionally, a stop member (not shown) dimensioned and shaped to fit slidably within the lower clevis member 3 can be seated on the shoulder 11.

The lower clevis member 3 is advantageously designed to comprise a main body 7 having a base 20 which extends upward in a column that has on its upperside facing the upper clevis member 2 a conically tapered pin entry guide 18 culminating at its nadir in a recess or socket 19 dimensioned and shaped to suitably receive the pin tip 10 of the pin 8 extending vertically from the upper clevis member 3. The conically tapered pin entry guide 18 guides the pin 8 into the recess 19 in the event the pin tip 10 deviates from the target of the recess 19 due to torque or twist of the lower clevis member 3 during erection of the tent frame. If the shoulder 11 of pin 8 contains a stop member, the stop member fits within recess 19.

Figure 1E:
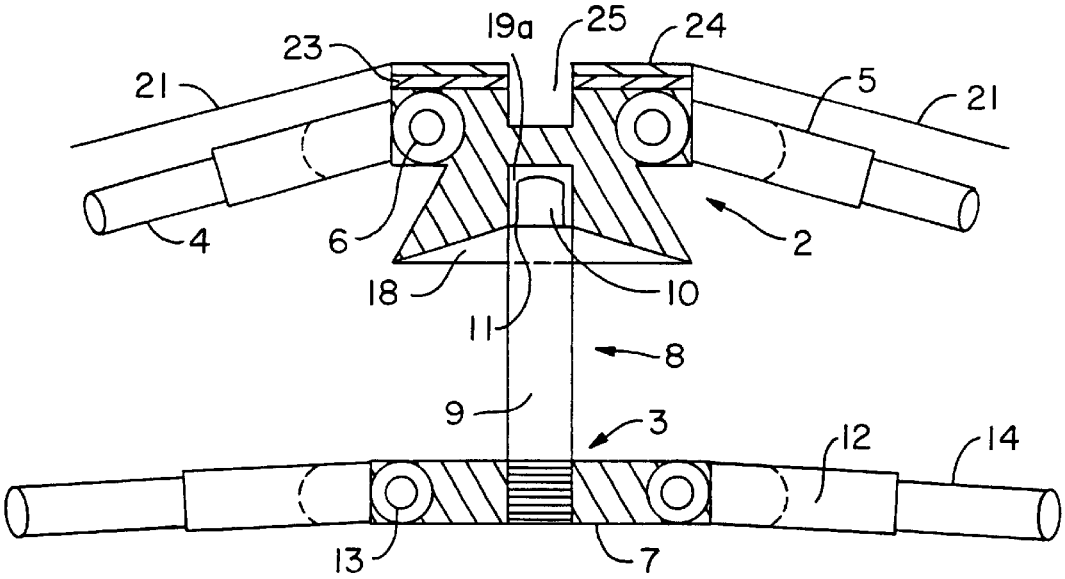
FIG. 1E is a cross sectional view of a clevis assembly with the upper clevis member having a conical pin entry guide on its underside and a centrally located fly adaptor recess on its upper surface and a lower clevis member having a pin projecting upwardly from its upper surface.

In the embodiment of the upper clevis 2 is shown in FIG. 1E, the main body 15 contains a recess or socket 19*a* instead of a vertical hollow opening with a recess as shown in FIG. 1A.

The upper clevis member 2 of the present invention can be further modified to contain a means for attaching a fly cover. As shown in FIGS. 1A and 1B the fly cover attaching means is the vertical hollow opening 17. The vertical hollow opening is dimensioned and shaped to suitably receive a fly adaptor assembly. When the tent fabric 21 is exterior to the tent frame, the tent fabric 21 is secured to the upper surface of upper clevis body 15 by any suitable fabric securing means. In one embodiment, the fabric securing means is velcro 23. When velcro is used for the tent fabric securing means, the tent fabric also contains velcro 24 on its underside. The tent fabric 21 is secured in a way to enable access to the vertical hollow opening 17.

A second embodiment for a fly cover attaching means is shown in FIGS. 1C and 1E. In this embodiment, the fly cover attaching means is a recess 25 centrally located in the upper part of upper clevis body 15. The recess 25 is dimensioned and shaped to suitably receive a fly adaptor assembly. Velcro 23, or other suitable fabric securing means, is provided on the upper surface of upper clevis body 15 for a tent in which the frame is interior to the fabric. The tent fabric 21 is secured in a way to enable access to the recess 25.

Figure 1F:
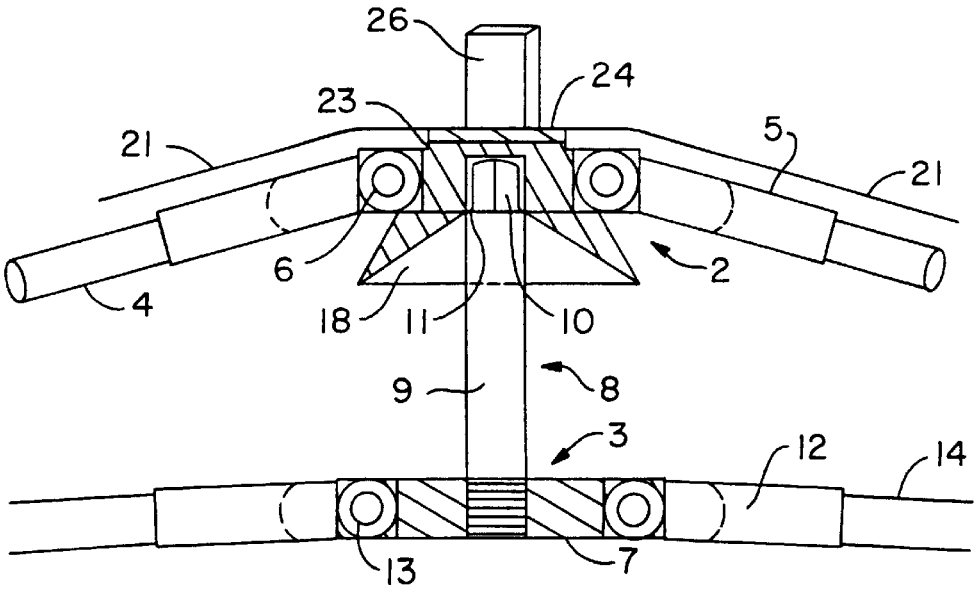
FIG. 1F is a cross sectional view of a clevis assembly of a collapsible tent with the upper clevis member having a conical pin entry guide on its underside and a fly adaptor pin protruding vertically from the center of its upper surface and a lower clevis member having a pin projecting upwardly from its upper surface.

A third embodiment of a fly cover attaching means is shown in FIG. 1F. The fly cover attaching means in this embodiment is a fly pin 26 which is centrally located on the upper surface of upper clevis body 15 and extends vertically from the clevis body 15. The fly pin is dimensioned and shaped to receive to suitably receive a fly adaptor assembly. The fly pin 26 may be square or rectangular as shown in FIG. 1F, or it may be circular. When the tent fabric is exterior to the tent frame, the tent fabric is dimensioned and shaped to accommodate the fly pin 26 through a grommet or seal 27.

Although the modifications to the upper clevis member 2 shown in FIGS. 1A–1G has been shown with reference to the tent fabric being on the exterior of the frame, the modified upper clevis member 2 can also be used with tents having the frame on the outside of the tent fabric.

Figure 1G:
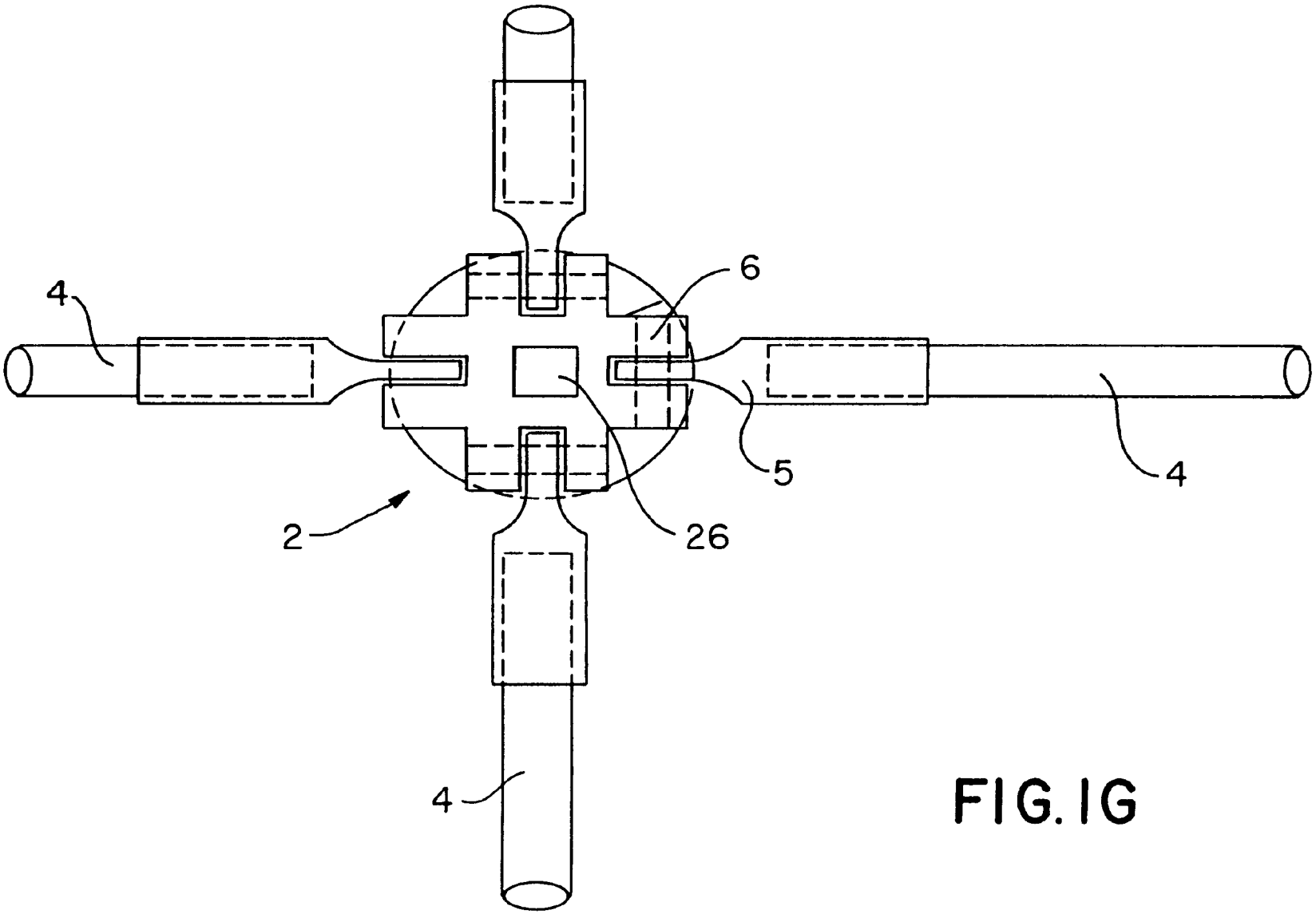
FIG. 1G is a top view of the upper clevis member shown in FIG. 1F.
Figure 2A:
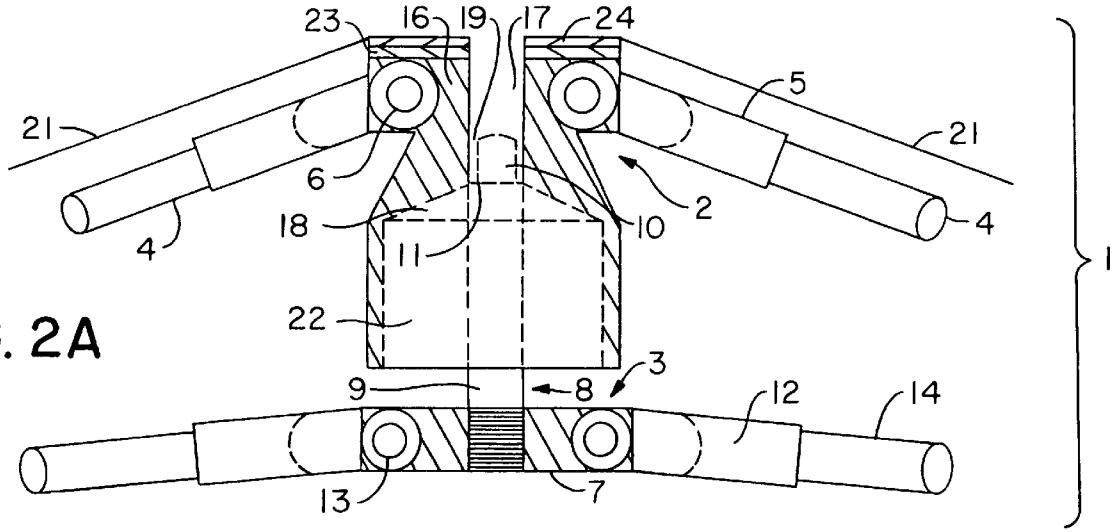
FIG. 2A is a cross sectional view of the clevis member shown in FIG. 1A with a shroud extension extending downwardly from the conical pin entry guide.
Figure 2B:
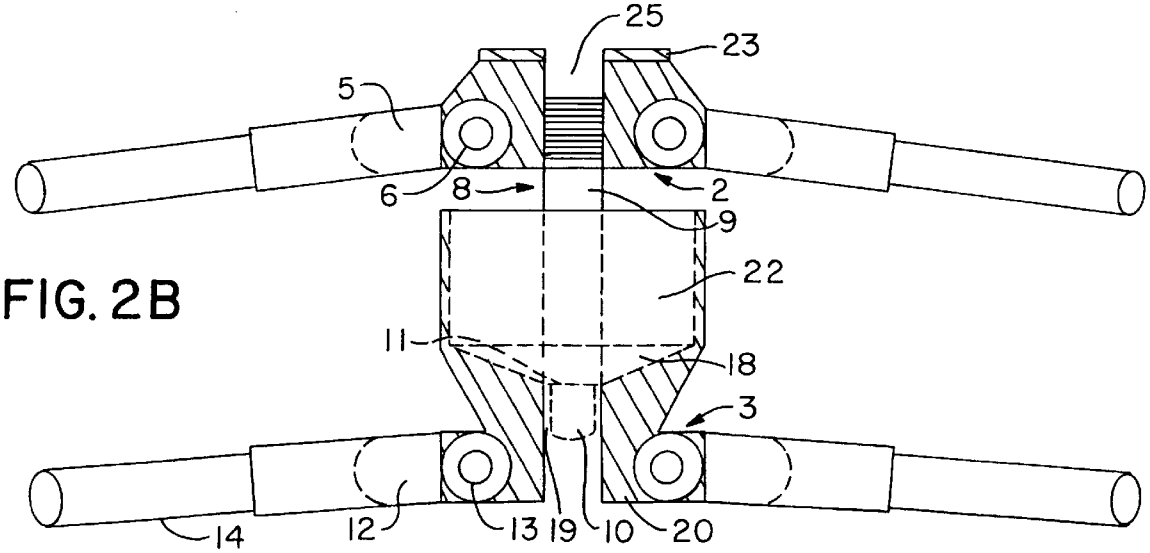
FIG. 2B is a cross sectional view of the clevis member shown in FIG. 1C with a shroud extension extending upwardly from the conical pin entry guide.

FIGS. 2A and 2B illustrate the modified clevis assembly having a shroud extension. The elements shown in these figures have the same meaning as the elements shown in FIGS. 1A–1G. The shroud extension can also be part of the clevis assembly shown in FIG. 1E having a fly adaptor recess or a part of the clevis assembly shown in FIG. 1F having a fly adaptor pin. In FIG. 2A, the base 16 extends downward in a column that has on its underside facing the lower clevis member 3 a conically tapered pin entry guide 18 culminating at its apex in a recess or socket 19 at the lower end of the hollow opening 17 and culminating at its nadir in a shroud extension 22 which extends downwardly from the conical end of the conical pin entry guide 18. The shroud extension 22 is preferably cylindrical in shape and an integral part of the conical pin entry guide 18 and base 16. In FIG. 2B, the lower clevis member 3 is advantageously designed to comprise a main body 7 having a base 20 which extends upward in a column that has on its upperside facing the upper clevis member 2 a conically tapered pin entry guide 18 culminating at its nadir in a recess or socket 19 and culminating at its apex in a shroud extension 22 which extends upwardly from the conical end of the conical pin entry guide 18. The shroud extension 22 is preferably cylindrical in shape and an integral part of the conical pin entry guide 18 and base 20. The shroud extension 22 intercepts pin 8 during erection of the tent and the conical pin entry guide 18 guides pin 8 into recess 19.

Figure 9:
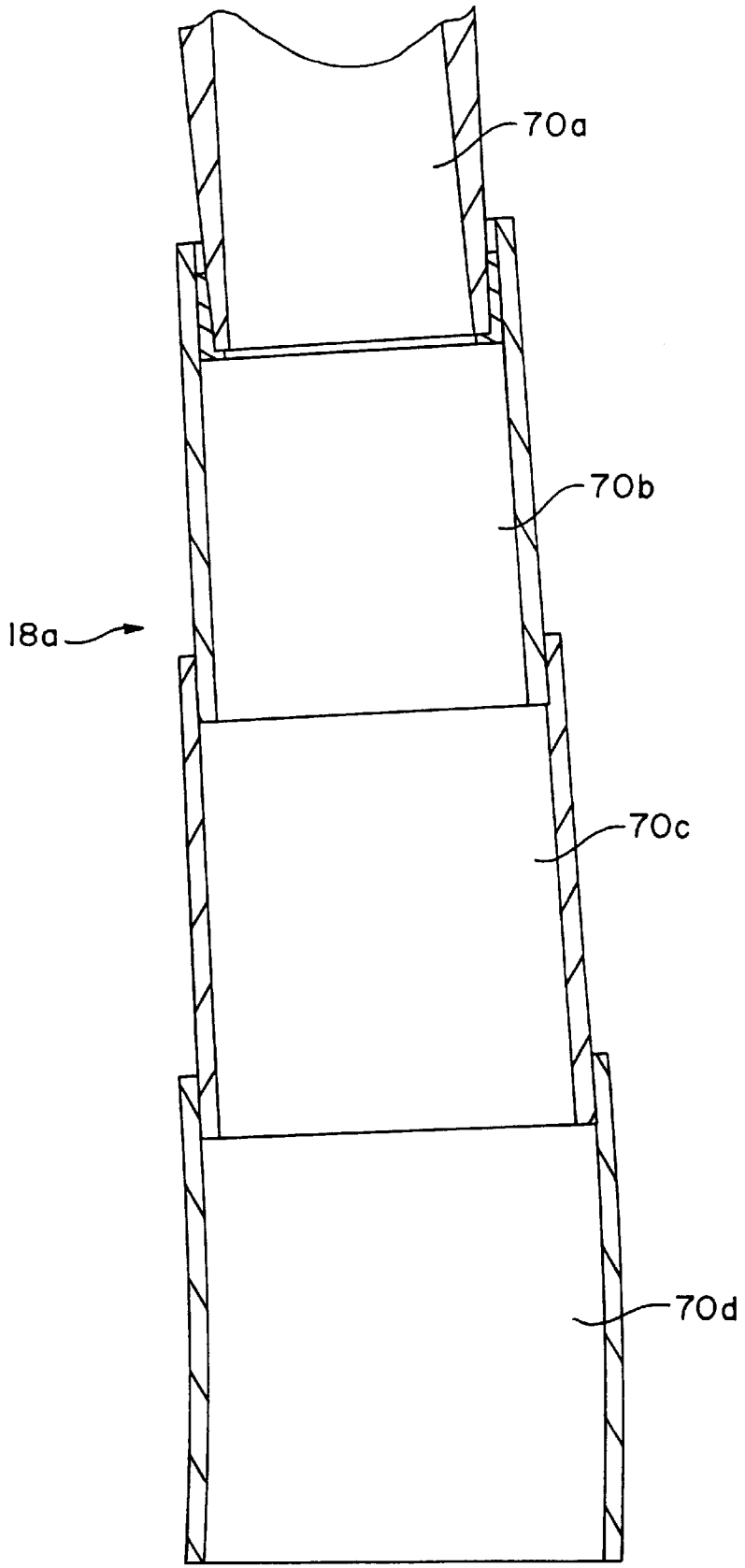
FIG. 9 shows a further embodiment of the conical pin entry guide which contains telescoping sections.

A further embodiment of the conical pin entry guide 18 is shown in FIG. 9, which illustrates a telescoping construction of the guide 18*a* as shown. As illustrated, the construction includes sections 70*a*–70*d* which telescope inside one another, when receiving the guide pin as in the other embodiments described herein. As should be understood, the top section 70*a* can be joined to the upper clevis member, for example, in place of the guide 18 shown in FIG. 1(A).

Figure 3B:
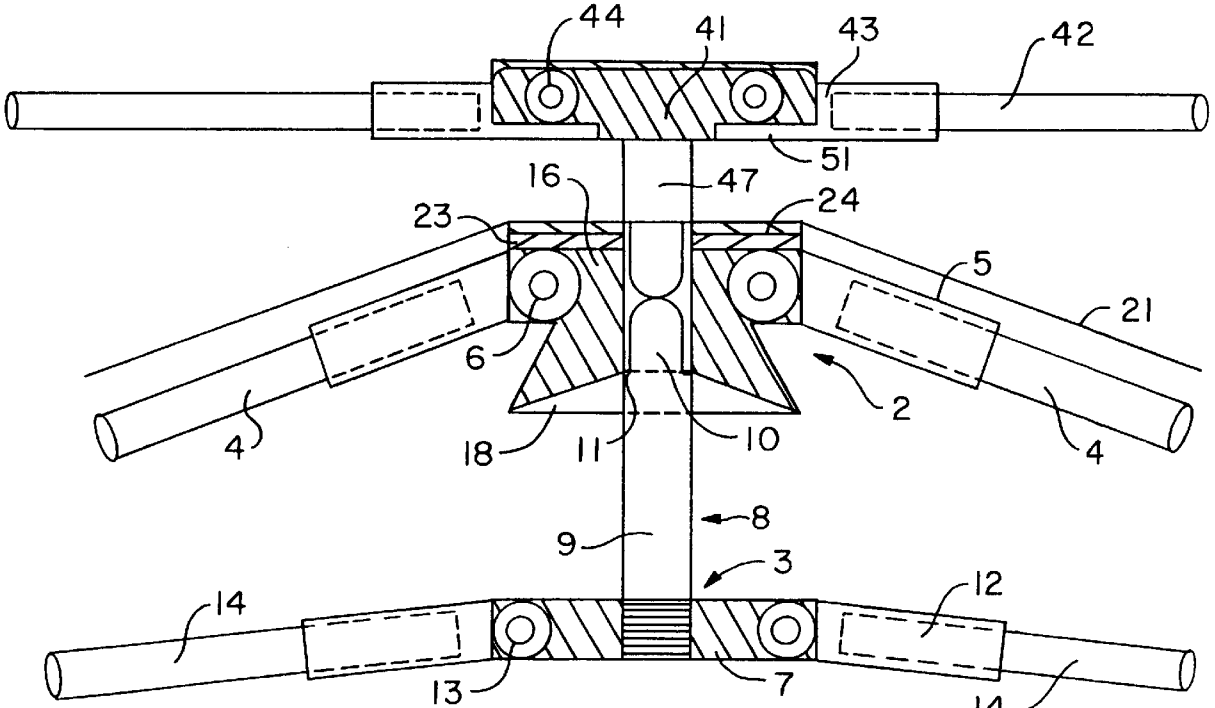
FIG. 3B is a cross sectional view of the fly adaptor assembly shown in FIG. 3A mounted into the fly adaptor receptacle of the upper clevis member of the clevis assembly shown in FIG. 1A.
Figure 3A:
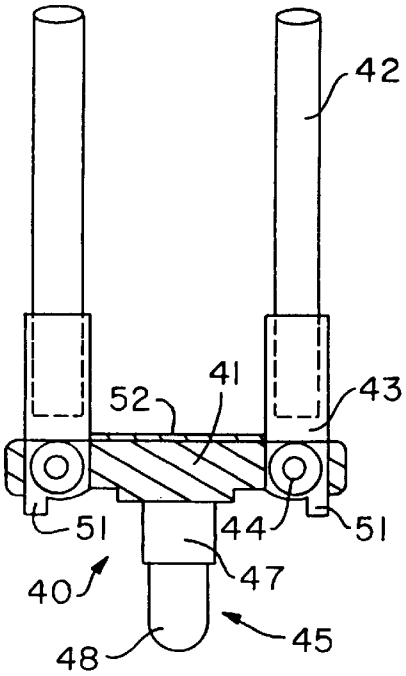
FIG. 3A is a cross sectional view of a fly adaptor assembly having a fly adaptor pin centrally located on the underside of the fly adaptor clevis to fit in a receptacle of the upper clevis member of a clevis assembly of a collapsible tent frame.
Figure 4A:
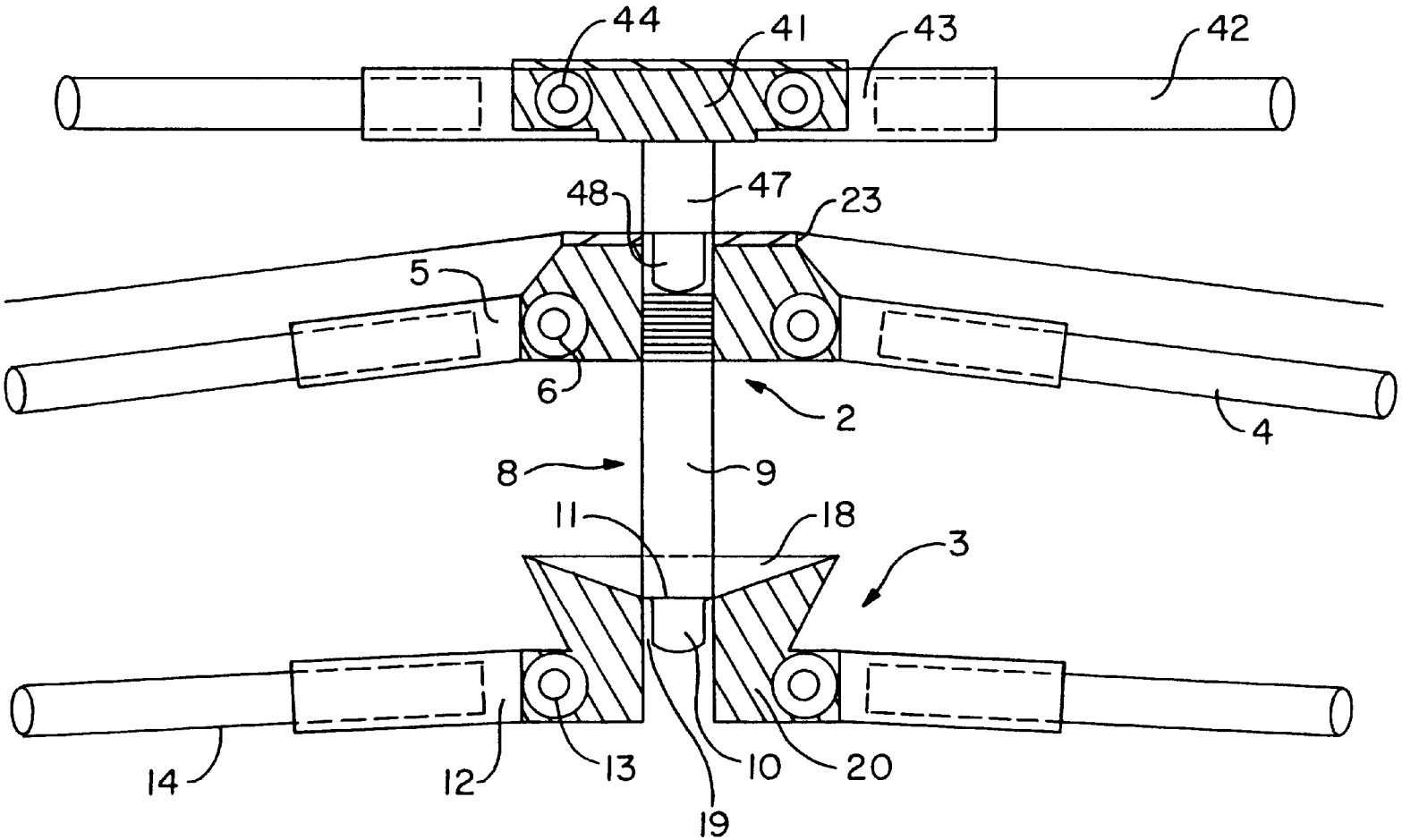
FIG. 4A is a cross sectional view of the fly adaptor assembly shown in FIG. 3A mounted into the fly adaptor receptacle of the upper clevis member of the clevis assembly shown in FIG. 1C.
Figure 5A:
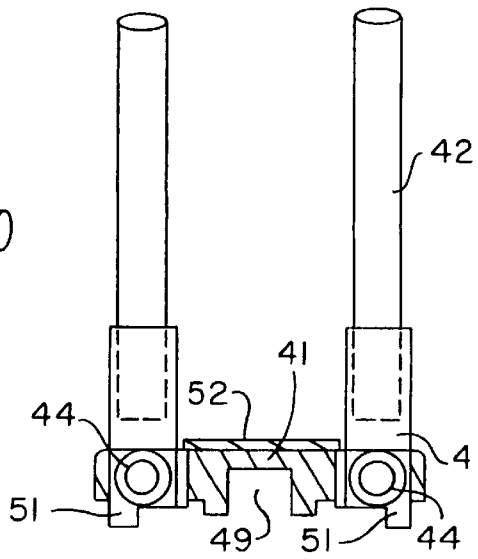
FIG. 5A is a cross sectional view of a fly adaptor assembly having a pin mount socket in the center of the underside of the fly adaptor clevis.
Figure 6A:
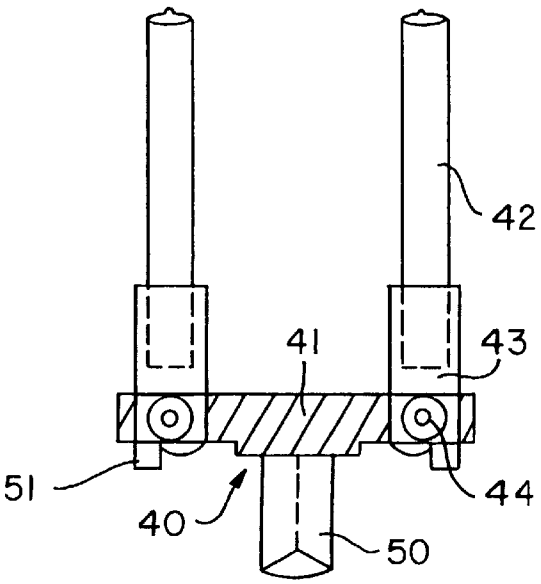
FIG. 6A is a cross sectional view of a fly adaptor assembly having a hollow mount pedestal in the center of the underside of the fly adaptor.

The fly adaptor assembly 40 of the present invention is illustrated in FIGS. 3A, 5A, and 6A. The fly adaptor assembly 40 preferably comprises a mechanism separate from the tent clevis assembly 1 and tent frame (not shown) that has a single fly clevis member 41 with a plurality of arms 42. Advantageously, the number of arms 42 corresponds to the number of legs of the tent frame. Each arm 42 is pivotally connected to the fly clevis member 41 by pivot connector 43 with pin 44. According to the embodiment shown in FIG. 3A, a downwardly protruding fly pin 45 is centrally located on the underside of fly clevis member 41. The fly pin 45 has a body 47 of larger diameter and fly pin tip 48 of small diameter at the lower end of fly pin 45. Fly pin 45 may be circular as shown in FIG. 3A, or it may be square or rectangular as shown in FIG. 4A. Fly pin 45 is dimensioned and shaped to engage the vertical hollow opening 17 or the recess 19 of upper clevis member 2.

In the embodiment shown in FIG. 5A, fly adaptor assembly 40 contains a fly mount socket 49 in the base of fly clevis member 41. The fly mount socket 49 is dimensioned and shaped to engage the fly pin 26 of the modified upper clevis member 2 shown in FIG. 1F.

In the embodiment shown in FIG. 6A, fly adaptor assembly 40 contains a hollow fly pedestal mount 50 on the underside of the base of fly clevis member 41. The hollow fly pedestal mount 50 is dimensioned and shaped to engage the fly pin 26 of the modified upper clevis member 2 shown in FIG. 1F.

Installation of the fly adaptor assembly to the clevis assembly of the tent frame is shown in FIGS. 3B, 4B, 4C, 5B, 5C and 6B. To install the fly adaptor assembly 40, the centrally located downwardly extended fly pin 45 from the underside of the fly adaptor assembly clevis 41 is inserted in the centrally located recess 19 or 19*a* or into the vertical hollow opening 17 of the upper clevis member 2 of the tent frame. If the tent fabric is exterior to the frame the fly pin 45 is inserted through a predesigned entry point in the fabric on the center of the top of the tent. Alternatively, the centrally located fly mount socket 49 or hollow pedestal mount 50 is inserted onto the upwardly facing fly pin 26 centrally located on the top surface of the upper clevis member 2. Once the fly adaptor assembly is mounted on the top of the tent, the plurality of arms 42 are brought downward to their locked position.

Figure 4B:
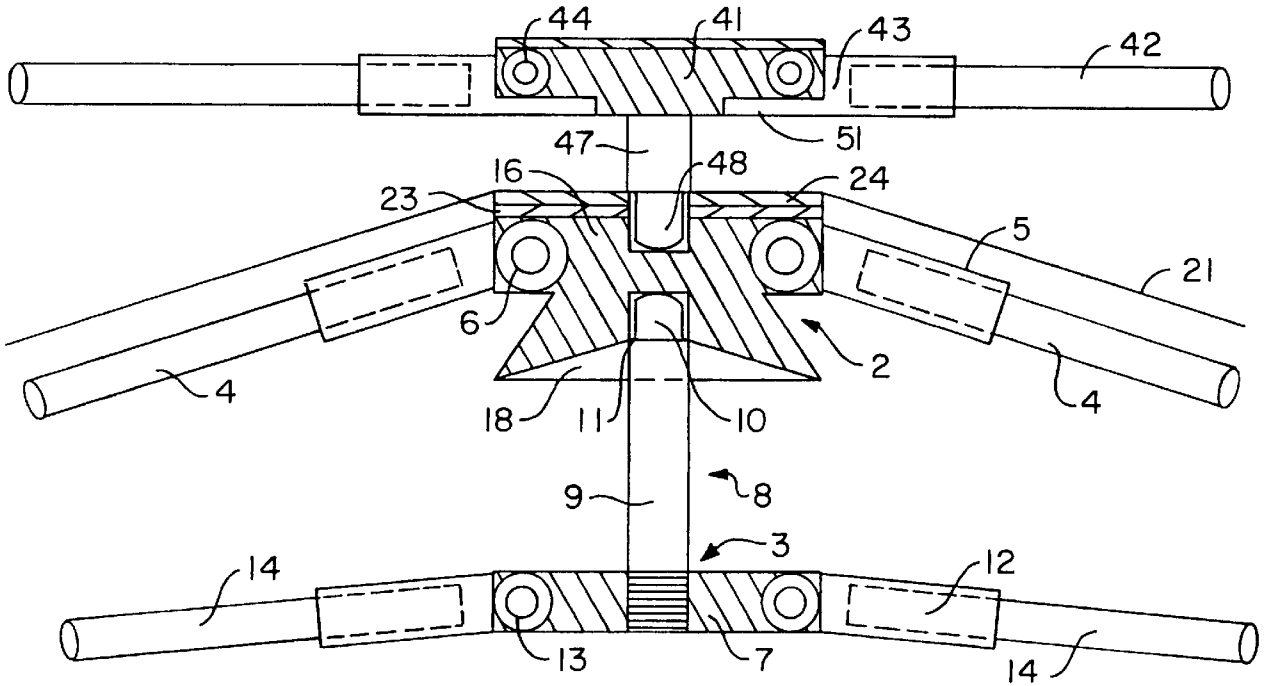
FIG. 4B is a cross sectional view of the fly adaptor assembly shown in FIG. 3A mounted into the fly adaptor receptacle of the upper clevis member of the clevis assembly shown in FIG. 1E.
Figure 4C:
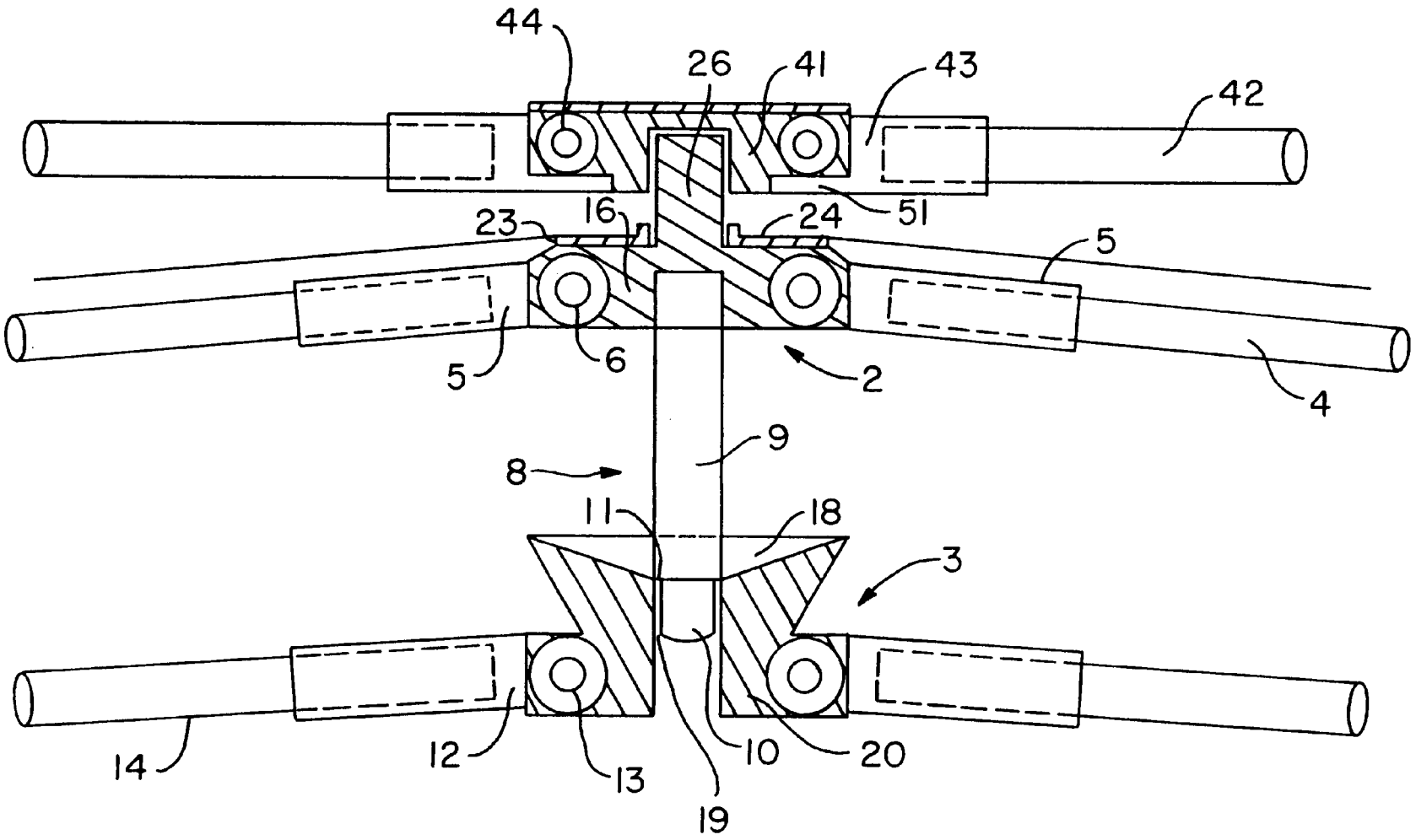
FIG. 4C is a cross sectional view of a fly adaptor assembly having a centrally located recess in the underside of the fly adaptor clevis member mounted onto the fly adaptor pin of an upper clevis member of a clevis assembly.
Figure 5B:
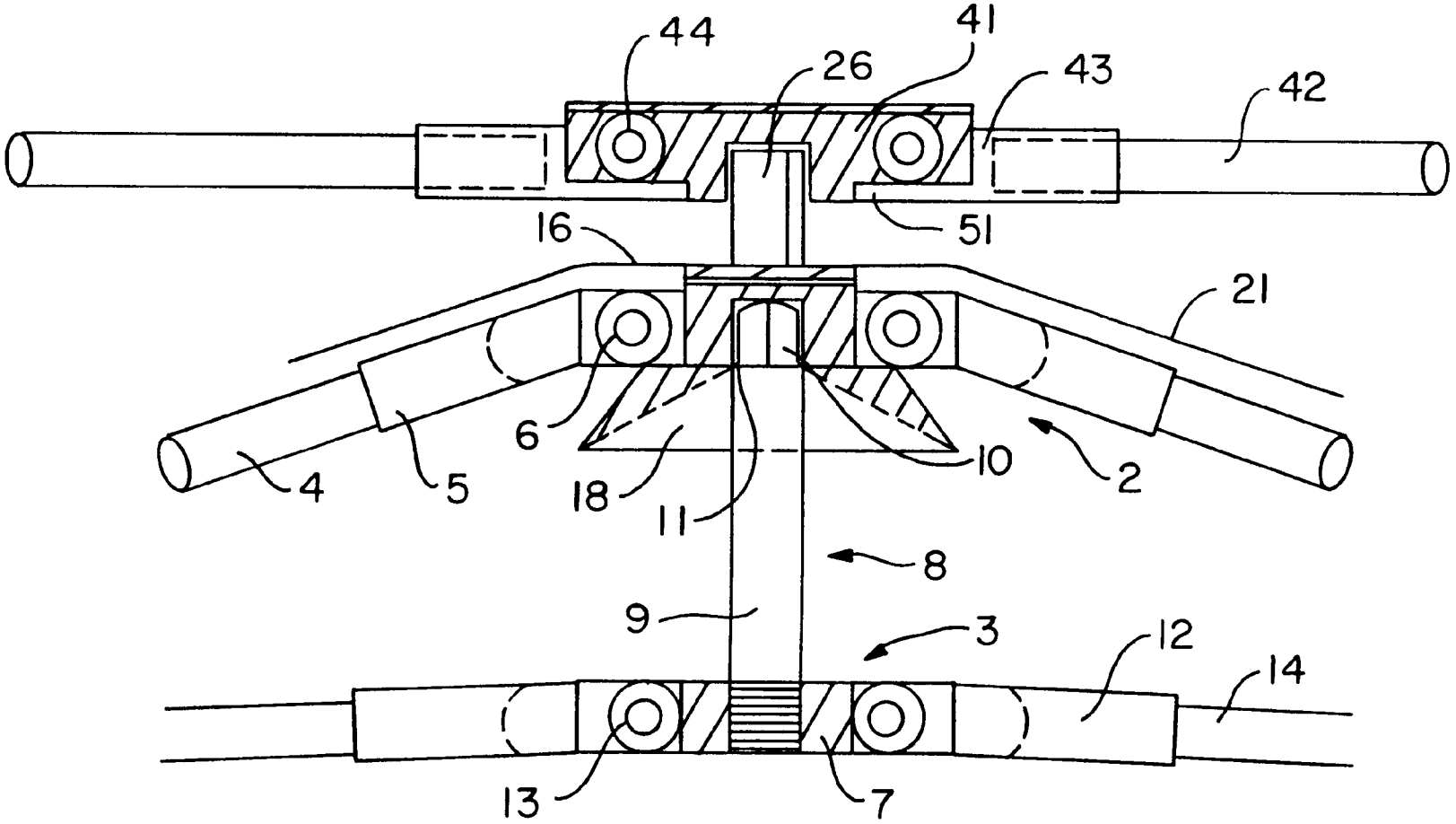
FIG. 5B is a cross sectional view of the fly adaptor assembly shown in FIG. 5A mounted onto the fly adaptor pin of the upper clevis member of the clevis assembly shown in FIG. 1F.
Figure 5C:
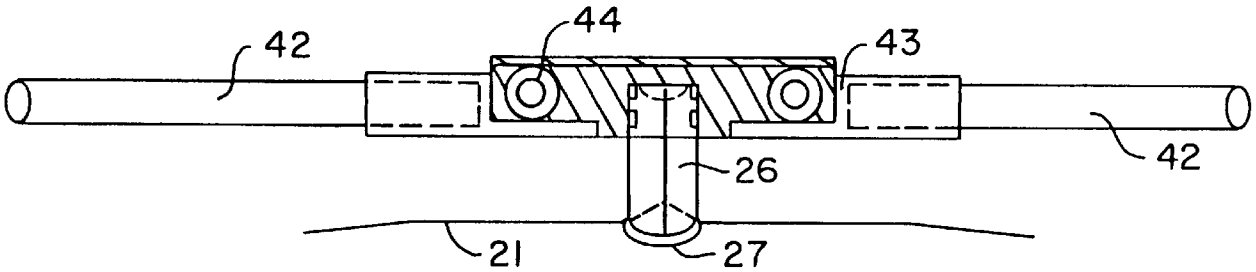
FIG. 5C is a cross sectional view of the fly adaptor assembly shown in FIG. 5A mounted onto the fly adaptor pin of the upper clevis member of FIG. 1F in which the clevis assembly is on the interior of the tent fabric.
Figure 6B:
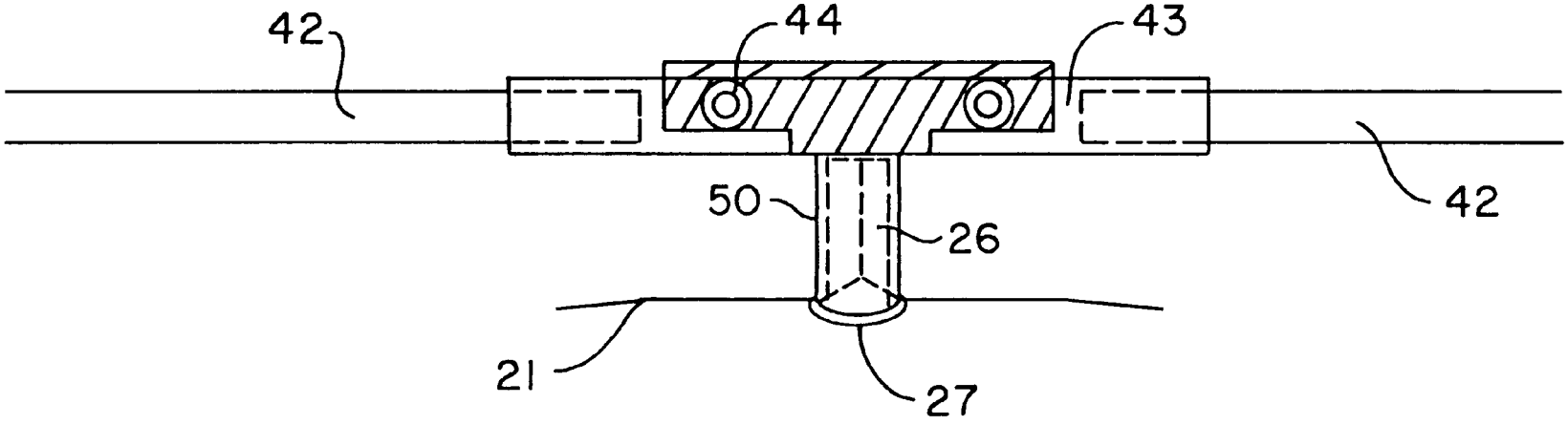
FIG. 6B is a cross sectional view of the fly adaptor assembly of FIG. 6A mounted onto the fly adaptor pin of the upper clevis member of FIG. 1F in which the clevis assembly is on the interior of the tent fabric.
Figure 7A:
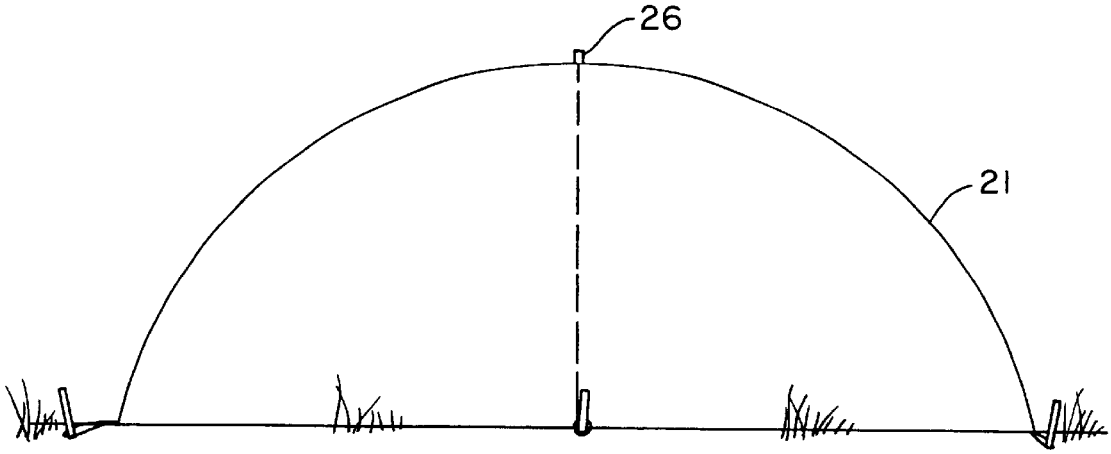
FIG. 7A is a general schematic of an erected collapsible umbrella tent showing the fly adaptor pin the same as that described in FIG. 1F protruding through the apex of the tent fabric.
Figure 7B:
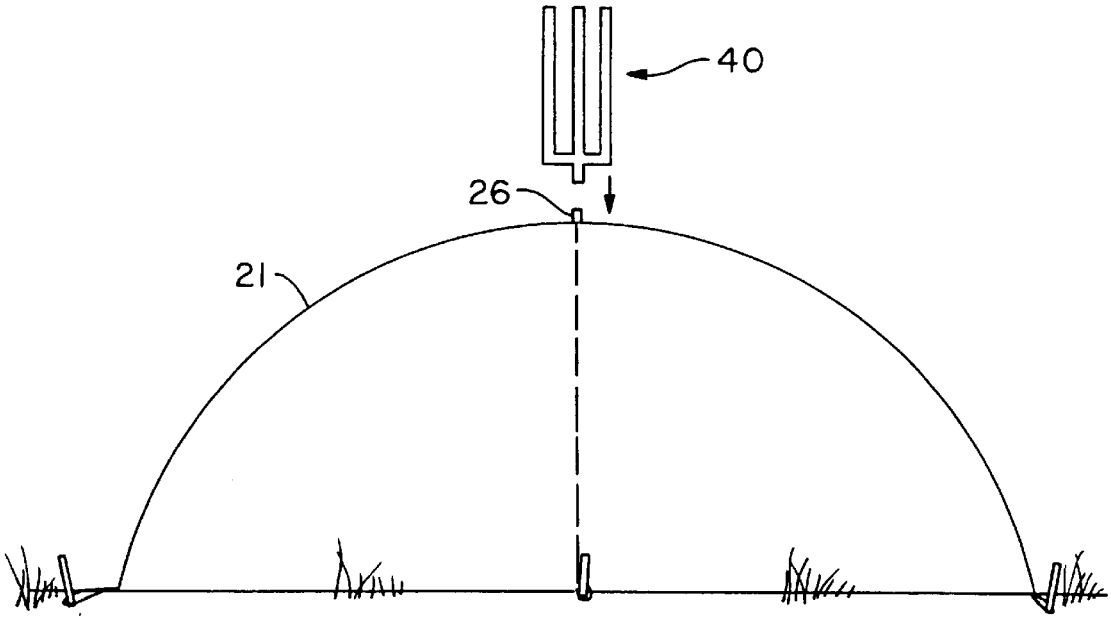
FIG. 7B is a general schematic of a tent described in FIG. 7A with a fly adaptor assembly having a hollow pedestal mount similar to that described in FIG. 6A.
Figure 7C:
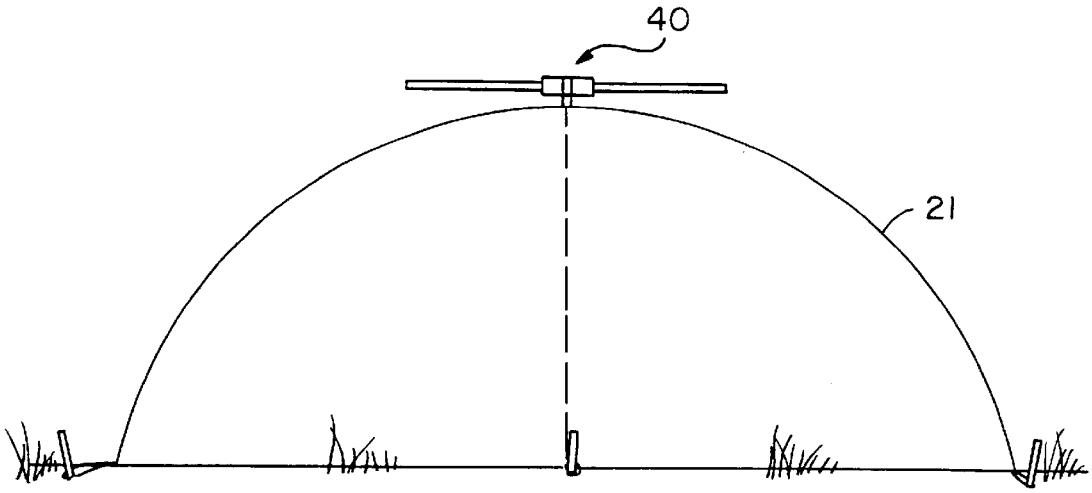
FIG. 7C is a general schematic of a tent described in FIG. 7A showing the fly adaptor assembly described in FIG. 7B mounted onto the fly adaptor pin.
Figure 7D:
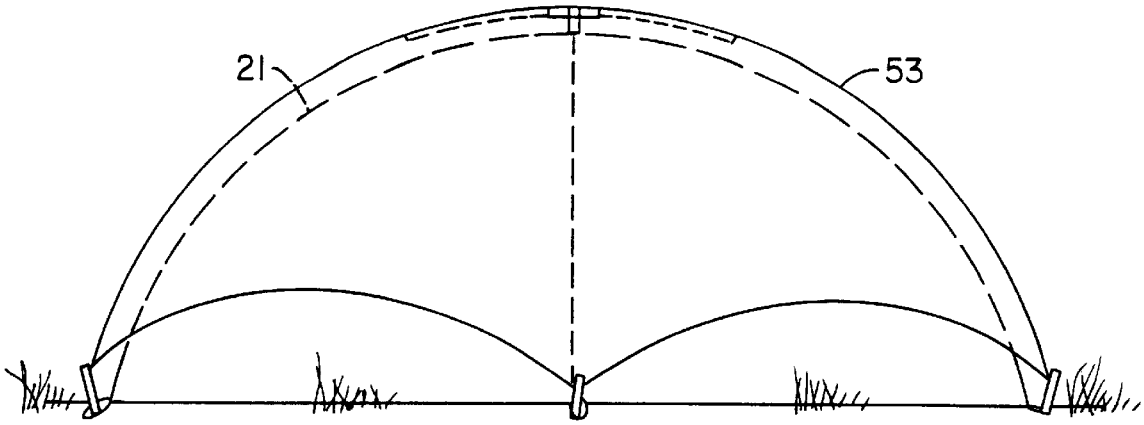
FIG. 7D is a general schematic showing a tent described in FIG. 7A showing the fly sheet fabric placed over the fly adaptor assembly described in FIG. 6A and secured by tie downs to the tent pegs.

The fly adaptor assembly 40 engaged with the vertical hollow opening 17 or the recess 19 or 19*a* of clevis assembly 1 is shown in FIGS. 3B, 4B and 5B. The fly adaptor assembly 40 engaged with the fly adaptor pin 26 of clevis assembly 1 is shown in FIG. 4C. The fly adaptor assembly 40 engaged with the fly adaptor pin 26 of the upper clevis member 2 in which the frame and clevis assembly 1 is interior of the tent fabric is shown in FIGS. 5C and 6B.

The shape and design of the mount (fly pin 45, mount socket 49 or pedestal mount 50) of the fly adaptor assembly 40 is such to allow the plurality of arms 42 on the fly adaptor assembly 40 to orient automatically with the orientation of the tent frame legs once the fly adaptor assembly arms 42 are rotated into position. Alternatively, if the recess 19 or 19*a* or vertical hollow opening 17 in the central portion of the upper surface of the upper clevis member 2 is circular and the fly pin 45 at the center of the base of the fly adaptor assembly clevis 41 is of a tubular or cylindrical design to fit into the recess 19 or 19*a* or vertical hollow opening 17, then the arms 42 of the fly adaptor assembly 40 can be manually rotated on the fly clevis 41 to orient the arms with the legs of the tent. The leg braking structures 51 on the pivot connectors 43 joining the arms 42 with the fly clevis member 41 of the fly adaptor assembly 40 are of a shape and configuration that allow each arm to be rotated into a pre-set horizontal position or, alternatively, into a pre-set position that may vary off of the horizontal if desired. The upper surface of the fly adaptor clevis member 41 can have velcro 52 or other material that can hold the fly sheet fabric.

When all of the arms 42 of the fly adaptor assembly 40 are locked downward in place, the fly sheet 53 is then extended over the fly adaptor assembly 40 by placing a predesigned target of the fly sheet 53 onto the upper surface of the fly adaptor assembly clevis member 41. This target area can be color coded on the fly sheet 53 or secured to the upper surface of the fly adaptor assembly clevis 41 through the use of an attachment such as velcro 52. The corners of fly sheet 53 are then tied down securely to the specific tie downs at the base of the legs or to the tent pins. This procedure is schematically presented in FIGS. 7A–7D. Conveniently the removal of the fly sheet 53 and fly adaptor assembly 40 is a simple reversal of the procedure used to install it.

Although the fly adaptor assembly of the present invention has been described to be separate from the clevis assembly, the fly adaptor assembly could be made to be an integral part of the clevis assembly. The fly adaptor assembly can also be used with the clevis assembly having the shroud extension.

Figure 8A:
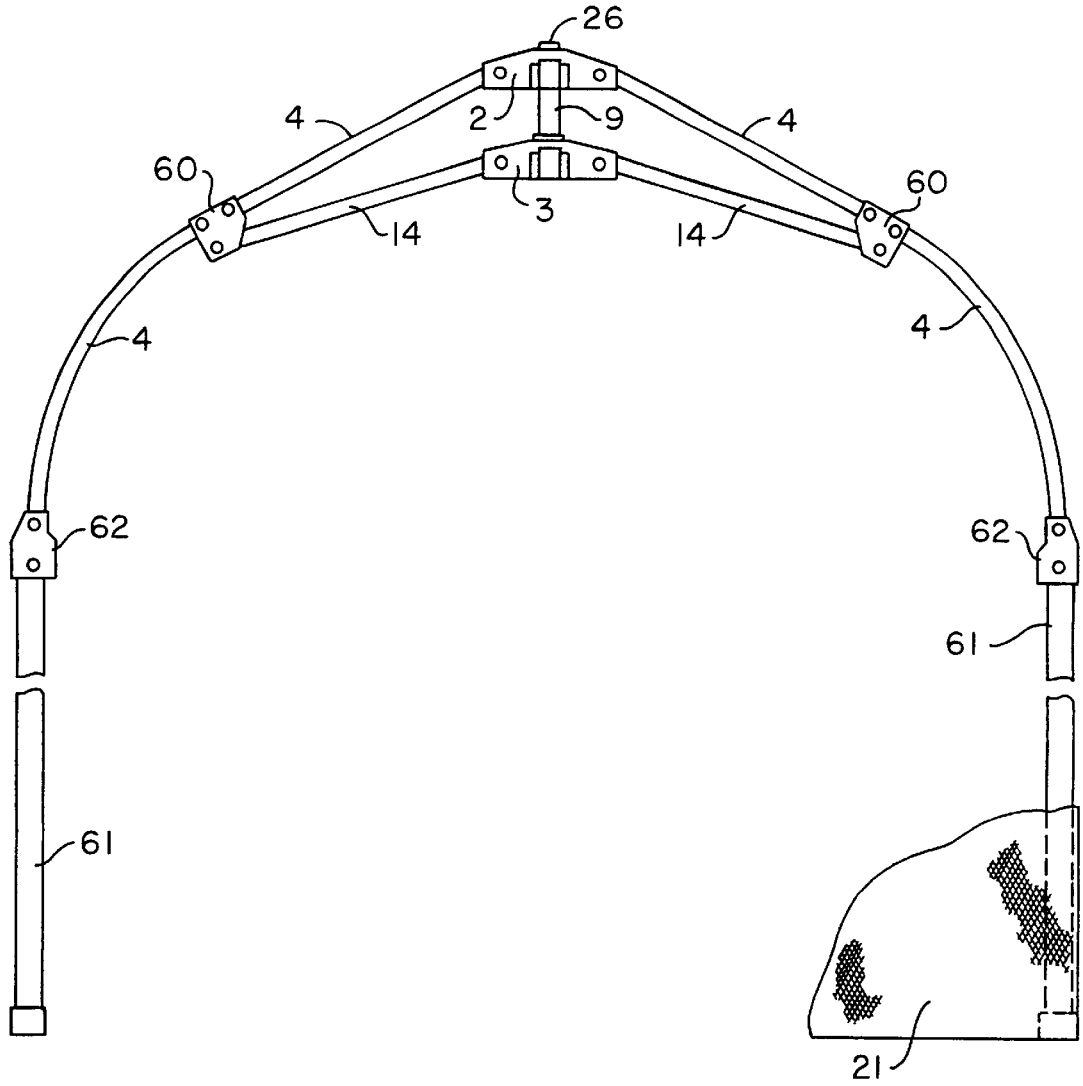
FIG. 8A is a semi-diagrammatic view of one embodiment of a tent and tent frame with the clevis assembly of the present invention.

As previously described, the modified clevis assembly of the present invention can be used with tent frames known in the art as illustrated by the patents set forth above. One such frame, as described in U.S. Pat. No. 4,945,936, with the modified clevis assembly is shown in FIG. 8A. The upper leg sections 4 are attached to the upper clevis member 2 as previously described. At a point intermediate its length, each upper leg section 4 is provided with pivot member 60 and a radial member 14. Each radial member 14 attaches to the lower clevis member 3 as previously described. Lower leg sections 61 are pivotally connected to the upper leg sections 4 by pivot connector 62.

Figure 8B:
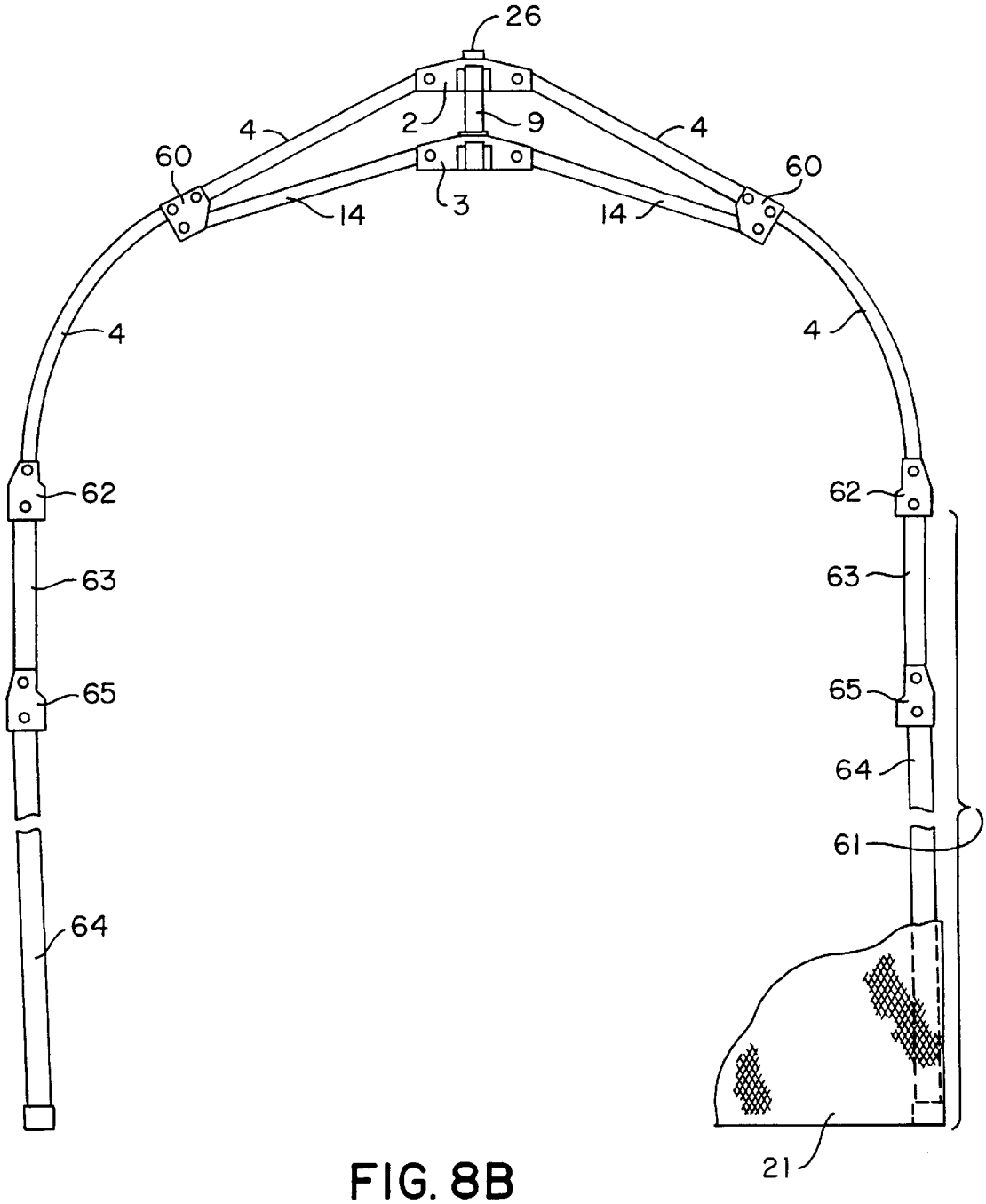
FIG. 8B is a semi-diagrammatic view of a second embodiment of a tent and tent frame with the clevis assembly of the present invention.

The clevis assembly preferably contains four legs as shown in FIGS. 1B, 1D and 1G. However, the clevis assembly ca be made to contain three to eight legs depending on the size of the tent. Larger tents can also be made by using more than one lower leg section for each leg, as shown in FIG. 8B. The upper portion 63 of lower leg section 61 is pivotally connected to an upper leg section 4 by pivot connector 62. The lower portion 64 of lower leg section 61 is pivotally connected to the upper portion 63 by pivot connectors 65.

It will be apparent that various changes and modifications can be made without departing from the scope of the invention as defined in the claims. Thus, certain arms of the fly adaptor assembly can be longer than others to allow for the fly sheet fabric to create a vestibule effect and, further, the invention can be made of any suitable material normally used in tent frame manufacturing or the invention can be used with tent frames manufactured from any suitable material.

What is claimed is:

1. A clevis assembly for use with a collapsible tent frame which comprises an upper clevis member and a lower clevis member, one of said clevis members having a vertical stop pin extending toward the other of said clevis members, one of said clevis members having an extension facing the clevis member with said vertical stop pin, said extension is tapered in a conical construction to form a conical pin entry guide and said conical construction terminates in a recess, said conical pin entry guide guides a tip of said vertical stop pin into said recess, the conical construction limits the movement of the clevis members toward each other and limits the torque or twist of the clevis members once the stop pin is engaged and locked into the recess.

2. The clevis assembly of claim 1 wherein said vertical stop pin extends upward from the lower clevis member and said conical construction extends downward from the upper clevis member.

3. The clevis assembly of claim 2 wherein said upper clevis member has a cylindrical shroud extension extending downward from said conical pin entry guide.

4. The clevis assembly of claim 1 wherein said vertical stop pin extends downward from the upper clevis member and said conical construction extends upward from the lower clevis member.

5. The clevis assembly of claim 4 wherein said lower clevis member has a cylindrical shroud extension extending upward from said conical pin entry guide.

6. The clevis assembly of claim 1 wherein said upper clevis member further has a centrally located recess on its upper surface for receiving a fly adaptor assembly.

7. The clevis assembly of claim 1 wherein said upper clevis member further has a centrally located vertical pin on its upper surface for engaging a fly adaptor assembly.

8. A collapsible tent frame comprising a plurality of legs and the clevis assembly of claim 1, wherein the legs are pivotally connected to the upper clevis member.

9. The collapsible tent frame of claim 8 having a fly adaptor assembly engaged in the recess or on the vertical pin of the upper clevis member, said fly adaptor assembly comprising a clevis member, a plurality of arms pivotally connected centrally to the clevis member and a centrally located vertical pin mount or a centrally located hollow pedestal mount on the lower surface of the clevis member.

10. The collapsible tent frame of claim 9, wherein said arms are automatically aligned with said legs upon engagement of the fly adaptor with the clevis assembly.

11. The collapsible tent frame of claim 9, wherein said arms are manually aligned with said legs upon engagement of the fly adaptor with the clevis assembly.

12. A collapsible tent comprising the collapsible tent frame of claim 8 and tent fabric attached interior to the tent frame.

13. A collapsible tent comprising the collapsible tent frame of claim 8 and tent fabric attached exterior to the tent frame.

14. The clevis assembly of claim 1 which further comprises a fly adaptor assembly, said fly adaptor assembly comprising a clevis member, a plurality of arms and a plurality of pivotal connectors connected centrally to the clevis member for pivotally connecting said arms.

15. A fly adaptor assembly comprising a clevis member, a plurality of arms, a plurality of pivotal connectors connected centrally to the clevis member for pivotally connecting said arms and a centrally located means for engaging a clevis assembly on the lower surface of the clevis member, wherein each pivotal connector has a stop lock to stop rotation of each arm when the assembly is in use.

16. The fly adaptor assembly of claim 15 wherein the engaging means is a vertical pin mount.

17. The fly adaptor assembly of claim 15 wherein the engaging means is a hollow pedestal mount.

18. The fly adaptor assembly of claim 15 wherein the engaging means is a recess.

19. The clevis assembly of claim 1, wherein said conical pin entry guide comprises a telescoping conical pin entry guide.

20. A collapsible tent frame comprising a plurality of legs and the clevis assembly of claim 6, wherein the legs are pivotally connected to the upper clevis member.

21. A collapsible tent frame comprising a plurality of legs and the clevis assembly of claim 7, wherein the legs are pivotally connected to the upper clevis member.

22. The collapsible tent frame of claim 20 having a fly adaptor assembly engaged in the recess or on the vertical pin of the upper clevis member, said fly adaptor assembly comprising a clevis member, a plurality of arms pivotally connected centrally to the clevis member and a centrally located vertical pin mount or a centrally located hollow pedestal mount on the lower surface of the clevis member.

23. The collapsible tent frame of claim 21 having a fly adaptor assembly engaged in the recess or on the vertical pin of the upper clevis member, said fly adaptor assembly comprising a clevis member, a plurality of arms pivotally connected centrally to the clevis member and a centrally located vertical pin mount or a centrally located hollow pedestal mount on the lower surface of the clevis member.

24. A collapsible tent comprising the collapsible tent frame of claim 9 and tent fabric attached interior to the tent frame.

25. A collapsible tent comprising the collapsible tent frame of claim 9 and tent fabric attached exterior to the tent frame.

26. The clevis assembly of claim 6 which further comprises a fly adaptor assembly, said fly adaptor assembly comprising a clevis member, a plurality of arms and a plurality of pivotal connectors connected centrally to the clevis member for pivotally connecting said arms.

27. The clevis assembly of claim 7 which further comprises a fly adaptor assembly, said fly adaptor assembly comprising a clevis member, a plurality of arms and a plurality of pivotal connectors connected centrally to the clevis member for pivotally connecting said arms.

* * * * *